US011609046B2

(12) United States Patent
Thobias et al.

(10) Patent No.: US 11,609,046 B2
(45) Date of Patent: *Mar. 21, 2023

(54) DETECTING LOSS OF CHARGE IN HVAC SYSTEMS

(71) Applicant: Lennox Industries Inc., Richardson, TX (US)

(72) Inventors: Patric Ananda Balan Thobias, Chennai (IN); Siddarth Rajan, Chennai (IN); Rakesh Goel, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/644,177

(22) Filed: Dec. 14, 2021

(65) Prior Publication Data

US 2022/0107135 A1 Apr. 7, 2022

Related U.S. Application Data

(63) Continuation of application No. 16/653,040, filed on Oct. 15, 2019, now Pat. No. 11,248,849.

(51) Int. Cl.

| | |
|---|---|
| ***F24F 11/36*** | (2018.01) |
| ***F25B 49/02*** | (2006.01) |
| ***F28D 1/04*** | (2006.01) |
| ***F24F 11/52*** | (2018.01) |
| ***F24F 5/00*** | (2006.01) |

(Continued)

(52) U.S. Cl.

CPC ..... *F28D 1/0417* (2013.01); *F24F 5/0035* (2013.01); *F24F 11/36* (2018.01); *F24F 11/52* (2018.01); *F24F 2140/20* (2018.01); *F24F 2140/50* (2018.01); *F25B 2500/222* (2013.01)

(58) Field of Classification Search

CPC .. F25B 2500/222; F25B 2500/24; F24F 11/36

See application file for complete search history.

(56) References Cited

U.S. PATENT DOCUMENTS

| | | | |
|---|---|---|---|
| 9,168,315 | B1 | 10/2015 | Scaringe et al. |
| 2001/0049942 | A1 | 12/2001 | Pham et al. |
| 2005/0056031 | A1 | 3/2005 | Jeong |

(Continued)

FOREIGN PATENT DOCUMENTS

| | | | |
|---|---|---|---|
| WO | 2019082331 | A1 | 5/2019 |

*Primary Examiner* — Jonathan Bradford

(74) *Attorney, Agent, or Firm* — Baker Botts L.L.P.

(57) ABSTRACT

An HVAC system includes an evaporator, a first sensor coupled to the evaporator at a first position, and a second sensor operably coupled to the evaporator at a second position. The first sensor monitors a first temperature of the refrigerant flowing in the evaporator at the first position, which is adjacent to the evaporator inlet. The second sensor monitors a second temperature of the refrigerant flowing in the evaporator at the second position, which is downstream from the first position. The system includes a controller, which receives a first signal corresponding to the first temperature and a second signal corresponding to the second temperature. The controller determines, based on the received signals, a temperature difference between the second temperature and the first temperature. In response to determining that the temperature difference is greater than a predefined threshold value, the controller determines that a loss of charge has occurred.

20 Claims, 4 Drawing Sheets

(51) Int. Cl.
*F24F 140/50* (2018.01)
*F24F 140/20* (2018.01)

(56) References Cited

U.S. PATENT DOCUMENTS

| | | | |
|---|---|---|---|
| 2013/0118195 | A1 | 5/2013 | Ikemiya et al. |
| 2013/0213083 | A1 | 8/2013 | Higashiue et al. |
| 2018/0292118 | A1 | 10/2018 | Suzuki et al. |
| 2021/0108857 | A1 | 4/2021 | Thobias et al. |

DETECTING LOSS OF CHARGE IN HVAC SYSTEMS

CROSS-REFERENCE TO RELATED APPLICATIONS

This application is a continuation of U.S. patent application Ser. No. 16/653,040 filed Oct. 15, 2019, by Patric Ananda Balan Thobias et al., and entitled "DETECTING LOSS OF CHARGE IN HVAC SYSTEMS," which is incorporated herein by reference.

TECHNICAL FIELD

The present disclosure relates generally to heating, ventilation, and air conditioning (HVAC) systems and methods of their use. In certain embodiments, the present disclosure relates to detecting loss of charge in HVAC systems.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as conditioned air.

SUMMARY OF THE DISCLOSURE

In an embodiment, a heating, ventilation and air conditioning (HVAC) system includes an evaporator coil with an inlet for flow of refrigerant into the evaporator coil and an outlet for flow of the refrigerant out of the evaporator coil. The HVAC system includes a first sensor operably coupled to the evaporator coil at a first position. The first sensor is configured to monitor a first temperature of the refrigerant flowing in the evaporator coil at the first position. The first position is adjacent to the inlet of the evaporator coil. The HVAC system includes a second sensor operably coupled to the evaporator coil at a second position. The second sensor is configured to monitor a second temperature of the refrigerant flowing in the evaporator coil at the second position. The second position is downstream from the first position (e.g., the second position may be located at between 10% and 90% of a length of a circuit of the evaporator coil). The HVAC system includes a controller communicatively coupled to the first sensor and the second sensor. The controller receives, from the first sensor, a first signal corresponding to the first temperature. The controller receives, from the second sensor, a second signal corresponding to the second temperature. The controller determines, based on the received first and second signals, a temperature difference between the second temperature and the first temperature. The controller compares the determined temperature difference to a predefined threshold value. In response to determining that the temperature difference is greater than the predefined threshold value, the controller determines that a loss of charge has occurred in the HVAC system.

In some cases, HVAC systems experience loss of charge, for example, because of a leak of refrigerant from system components or conduit connecting components. A loss of charge may be detected by measuring a superheat value associated with an HVAC system. A superheat value, or "superheat," is generally the temperature difference between the temperature of superheated vapor refrigerant exiting an evaporator coil of the HVAC system and the saturation temperature of refrigerant flowing through the evaporator coil. In some cases, a pressure sensor may be used to measure the saturation temperature indirectly via measurement of a saturation pressure. In some cases, two temperature sensors may be used to measure a superheat value. However, the misplacement of even one temperature sensor can lead to errors in the detection of a loss of charge. For instance, if a temperature sensor is incorrectly positioned, saturation temperature will be measured incorrectly, resulting in an erroneous superheat measurement and a failure to detect a loss of charge. For example, if a temperature sensor for measuring a saturated suction temperature in an evaporator coil is placed at a position too far downstream in an evaporator coil, changes in superheat value (e.g., associated with a loss of charge) may not be effectively detected, because the appropriate position for measuring superheat value may shift upstream as a system loses charge. A failure to detect a loss of charge may result in inefficient operation of the HVAC system and damage to the HVAC system.

The unconventional HVAC system contemplated in this disclosure solves problems of previous technology, including those described above, by facilitating improved detection of system faults such as loss of charge (e.g., from refrigerant leaks) or low airflow conditions. The present disclosure encompasses the recognition that system faults can be detected by measuring a difference in temperature taken at two positions along the length of an evaporator coil (e.g., or along the length of a circuit of an evaporator coil). For example, a "normally" functioning HVAC system (e.g., a system not experience a fault) may have a relatively constant temperature difference between the two positions, and the temperature difference may remain below a threshold temperature value when there is no loss of charge. In contrast, a loss of charge may cause the temperature difference to increase beyond the threshold value. Accordingly, rather than measuring a superheat value (e.g., using a high cost pressure sensor), two low-cost temperature sensors can be employed to monitor temperature difference along the length of an evaporator coil and detect faults via the monitored temperature difference. In some embodiments, the systems and methods described in this disclosure are configured to exploit spatial temperature difference measurements along the length of the evaporator coil to effectively discern between faults associated with a loss of charge and faults associated with an insufficient airflow rate across the evaporator coil. These faults generally could not be distinguished using previous technologies. Moreover, the systems and methods described in this disclosure may be integrated into a practical application for improving the performance of HVAC systems by, in some embodiments, both preventing damage to HVAC system and reducing and/or eliminating unnecessary HVAC system downtime because of an incorrectly diagnosed fault.

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

As described above, prior to the present disclosure, there was a lack of tools for reliably detecting loss of charge in an HVAC system. This disclosure encompasses the unique recognition that loss of charge can be detected via a temperature difference at two positions along the length of an evaporator coil, rather than measuring a superheat value. Moreover, this disclosure also encompasses the recognition that the position at which a temperature (e.g., a suction temperature) for measuring a superheat value should be measured shifts upstream during a loss of charge. Accordingly, the temperature difference between a first position near the inlet of an evaporator coil and a second position downstream (e.g., at a position of 10% or 90% of the length of the coil or circuit of the coil) may increase when there is a loss of charge. If the temperature at the first position decreases below a threshold value without the temperature difference increasing, the evaporator coil may be receiving an insufficient airflow.

HVAC System

Figure 1:
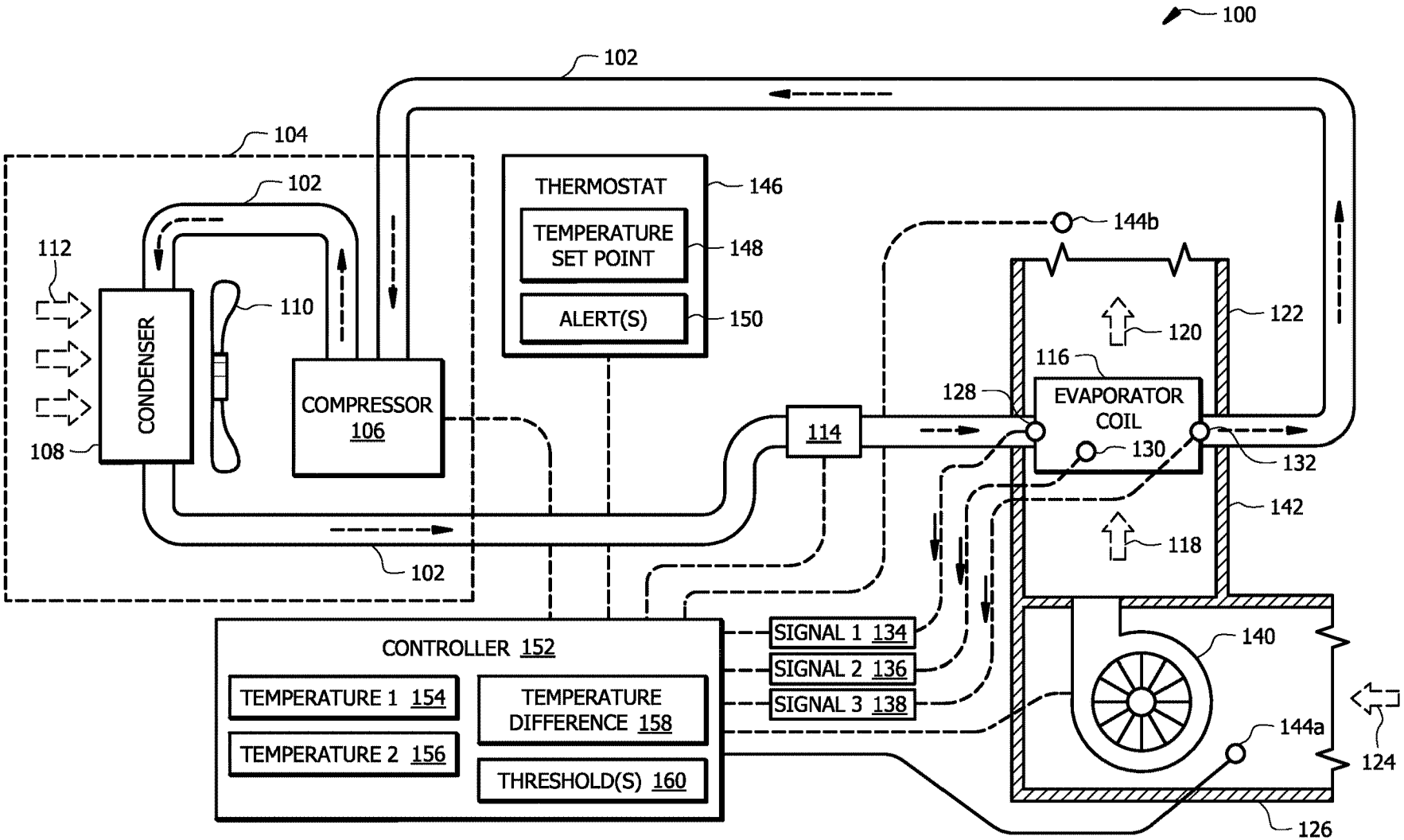
FIG. 1 is a diagram of an example HVAC system configured for the detection of system faults.

FIG. 1 is a schematic diagram of an embodiment of an HVAC system 100 configured for the efficient detection of system faults during its operation. In general, sensors 128 and 130 are operably coupled to (e.g., disposed in or on) evaporator coil 116 and provide signals 134, 136 which may be used to detect system faults. The HVAC system 100 conditions air for delivery to a conditioned space. The conditioned space may be, for example, a room, a house, an office building, a warehouse, or the like. In some embodiments, the HVAC system 100 is a rooftop unit (RTU) that is positioned on the roof of a building and the conditioned air is delivered to the interior of the building. In other embodiments, portion(s) of the system may be located within the building and portion(s) outside the building. The HVAC system 100 may include one or more heating elements, not shown for convenience and clarity. The HVAC system 100 may be configured as shown in FIG. 1 or in any other suitable configuration. For example, the HVAC system 100 may include additional components or may omit one or more components shown in FIG. 1.

The HVAC system 100 includes a working-fluid conduit subsystem 102, at least one condensing unit 104, an expansion valve 114, an evaporator coil 116, a blower 140, a thermostat 146, and a controller 152. The controller 152 of the HVAC system 100 is generally configured to detect system faults (e.g., loss of charge and/or improper rate of airflow 118 across evaporator coil 116) based on temperature signals 134 and 136 received from sensors 128 and 130, respectively. Temperature sensors 128 and 130 are positioned along the length of the evaporator coil 116 (e.g., as described in greater detail with respect to FIG. 2 below) to facilitate the effective detection of system faults via measurements of temperature difference 158. In response to detecting a fault, a signal may be transmitted to thermostat 146 (and/or to a remote device of an administrator tasked with maintaining HVAC system 100) for display as an alert 150. In some embodiments, the controller 152 may detect a critical system fault and cause the HVAC system 100 to be turned off or cease operation (e.g., by shutting off the compressor 106 and blower 140), thereby preventing critical damage to the HVAC system 100.

The working fluid conduit subsystem 102 facilitates the movement of a working fluid (e.g., a refrigerant) through a cooling cycle such that the working fluid flows as illustrated by the dashed arrows in FIG. 1. The working fluid may be any acceptable working fluid including, but not limited to hydroflurocarbons (e.g. R-410A) or any other suitable type of refrigerant.

The condensing unit 104 includes a compressor 106, a condenser 108, and a fan 110. In some embodiments, the condensing unit 104 is an outdoor unit while other components of system 100 may be located indoors. The compressor 106 is coupled to the working-fluid conduit subsystem 102 and compresses (i.e., increases the pressure of) the working fluid. The compressor 106 of condensing unit 104 may be a single-stage compressor, a variable-speed compressor, or multi-stage compressor. A variable-speed compressor is generally configured to operate at different speeds to increase the pressure of the working fluid to keep the working fluid moving along the working-fluid conduit subsystem 102. In the variable-speed compressor configuration, the speed of compressor 106 can be modified to adjust the cooling capacity of the HVAC system 100. In the multi-stage compressor configuration, one or more compressors can be turned on or off to adjust the cooling capacity of the HVAC system 100.

The compressor 106 is in signal communication with the controller 152 using wired or wireless connection. The controller 152 provides commands or signals to control operation of the compressor 106 and/or receives signals from the compressor 106 corresponding to a status of the compressor 106. For example, when the compressor 106 is a variable-speed compressor, the controller 152 may provide signals to control compressor speed. When the compressor 106 operates as a multi-stage compressor, the signals may correspond to an indication of which compressors to turn on and off to adjust the compressor 106 for a given cooling capacity. The controller 152 may operate the compressor 106 in different modes corresponding to load conditions (e.g., the amount of cooling or heating required by the HVAC system 100). The controller 152 is described in greater detail below and with respect to FIG. 4.

The condenser 108 is configured to facilitate movement of the working fluid through the working-fluid conduit subsystem 102. The condenser 108 is generally located downstream of the compressor 106 and is configured to remove heat from the working fluid. The fan 110 is configured to move air 112 across the condenser 108. For example, the fan 110 may be configured to blow outside air through the condenser 108 to help cool the working fluid flowing there through. The compressed, cooled working fluid flows from the condenser 108 toward an expansion device 114.

The expansion device 114 is coupled to the working-fluid conduit subsystem 102 downstream of the condenser 108 and is configured to remove pressure from the working fluid. In this way, the working fluid is delivered to the evaporator coil 116 and receives heat from airflow 118 to produce a conditioned airflow 120 that is delivered by a duct subsystem 122 to the conditioned space. In general, the expansion device 114 may be a valve such as an expansion valve or a flow control valve (e.g., a thermostatic expansion valve valve) or any other suitable valve for removing pressure from the working fluid while, optionally, providing control of the rate of flow of the working fluid. The expansion device 114 may be in communication with the controller 152 (e.g., via wired and/or wireless communication) to receive control signals for opening and/or closing associated valves and/or provide flow measurement signals corresponding to the rate of working fluid through the working-fluid conduit subsystem 102.

The evaporator coil 116 is generally any heat exchanger configured to provide heat transfer between air flowing through (or across) the evaporator coil 116 (i.e., air contacting an outer surface of the evaporator coil 116) and working fluid passing through the interior of the evaporator coil 116. The evaporator coil 116 may include one or more circuits of coils, as described in greater detail below with respect to FIG. 2. The evaporator coil 116 is fluidically connected to the compressor 106, such that working fluid generally flows from the evaporator coil 116 to the condensing unit 104. A portion of the HVAC system 100 is configured to move air 118 across the evaporator coil 116 and out of the duct sub-system 122 as conditioned airflow 120. Return air 124, which may be air returning from the building, fresh air from outside, or some combination, is pulled into a return duct 126.

Sensors 128, 130, 132 may be disposed on or in evaporator coil 116. Sensors 128, 130, 132 may include temperature and/or pressure sensors. In some embodiments, each of sensors 128, 130, 132 is a temperature sensor, thereby decreasing cost and maintenance considerations for HVAC system 100. In some embodiments, one or more of the sensors 128, 130, 132 includes a pressure sensor. For instance, sensor 128, placed at or adjacent to the inlet of the evaporator coil 116 may include a pressure sensor, which is configured to measure a pressure. The pressure may be used to calculate a corresponding saturated suction temperature of working fluid at this position in the evaporator coil 116. Measurement data (e.g., temperature and/or pressure information) from sensors 128, 130, 132 may be transmitted to controller 152 via corresponding signals 134, 136, 138 illustrated in FIG. 1.

Figure 2:
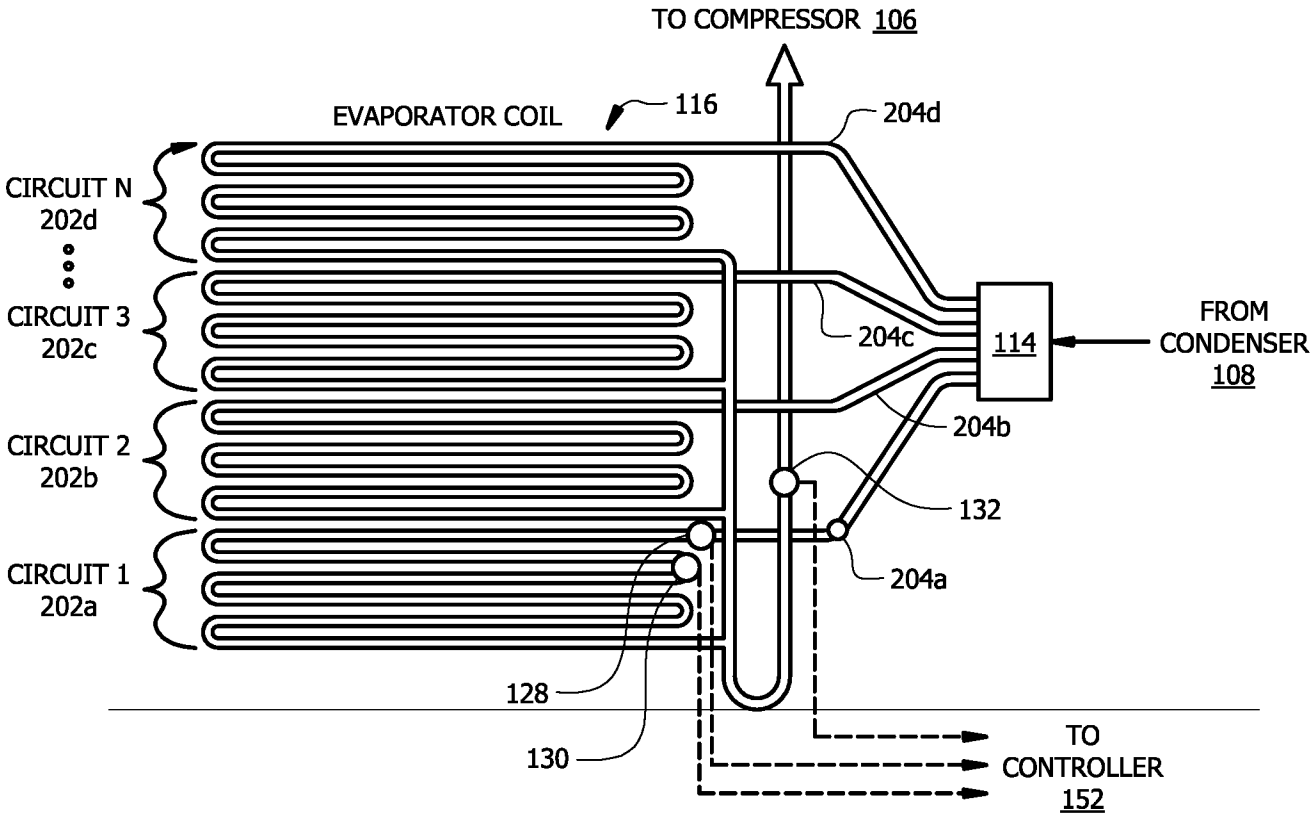
FIG. 2 is a diagram of an example evaporator coil of the HVAC system illustrated in FIG. 1.

FIG. 2 illustrates an example evaporator coil 116 in further detail. Evaporator coil 116 includes a plurality of circuits 202*a-d*. In general, the evaporator coil 116 may have any number of circuits. In certain embodiments, the evaporator coil 116 has between four and sixteen circuits 202*a-d*. Working fluid passes through expansion device 116 and enters the evaporator coil 116 via inlets 204*a-d*. Sensor 128 is positioned at or adjacent to (e.g., within about 5% of the length of the circuit 202*a* from) the inlet 204*a*. Accordingly, sensor 128 may be positioned and configured to measure a first temperature 154 of the working fluid as it enters the evaporator coil 116. Sensor 130 is positioned downstream form sensor 128 (e.g., within about 10% to 90% of the length of the circuit 202*a* from the inlet 204*a*). Accordingly, sensor 128 may be positioned and configured to measure a second temperature 156 of the working fluid after it has passed some distance through the evaporator coil 116. In general, the first temperature 154 measured via sensor 128 is less than the second temperature 156 measured via sensor 130.

Under "normal" operating conditions when there is no system fault, the temperature difference 158 between the second temperature 156 and first temperature 154 (i.e., Temperature 2-Temperature 1) is below a predetermined threshold value (e.g., of about 7° F.). Under normal conditions, the first temperature 154 is generally greater than a second threshold value (e.g., of 32° F.). Thresholds 160 of FIG. 1 are stored in memory of the controller 152 may include this predetermined threshold value along with any other threshold described in this disclosure (see FIG. 4). The temperature-difference threshold value may be determined based on the distance between the first and second sensors 128, 130 and other properties and operating characteristics of the HVAC system 100 (e.g., the temperature of the working fluid entering the evaporator coil 116, the temperature of airflow 118 across the evaporator coil 116, etc.). When the temperature difference 158 exceeds the threshold value (e.g., of about 7° F.), the system 100 has experienced a loss of charge. A temperature and/or pressure determined by sensor 128 may further be employed to determine whether the charge is critically low or if the rate of airflow 118 provided by blower 140 is low, as described in greater detail below.

An optional third sensor 132 may be placed in or on the outlet line of the evaporator coil 116. For example, sensor 132 may be located at greater than 90% of a length of a circuit of the evaporator coil. Optional sensor 132, for example, may be used to measure a suction temperature of the HVAC system 100. The suction temperature may be used to calculate a superheat value, as described above, or to provide further insight into the performance of HVAC system 100. While the illustrative example of FIG. 2 shows sensors 128, 130, 132 operably coupled to (e.g., disposed on or in) the first circuit 202*a* of evaporator coil 116, it should be understood that the sensors 128, 130, 132 may be operably coupled to any of the circuits 202*a-d*. Moreover, additional sensors may be included, for example, to measure temperature differences in two or more circuits 202*a-d* of the evaporator coil 116.

Referring again to FIG. 1, a suction side of the blower 140 pulls the return air 124. The blower 140 discharges airflow 118 into a duct 142 such that airflow 118 crosses the evaporator coil 116 or heating elements (not shown) to produce conditioned airflow 120. The blower 140 is any mechanism for providing a flow of air through the HVAC system 100. For example, the blower 140 may be a constant-speed or variable-speed circulation blower or fan. Examples of a variable-speed blower include, but are not limited to, belt-drive blowers controlled by inverters, direct-drive blowers with electronic commuted motors (ECM), or any other suitable type of blower. The blower 140 is in signal communication with the controller 152 using any suitable type of wired or wireless connection. The controller 152 is configured to provide commands and/or signals to the blower 140 to control its operation. For example, the controller 152 may be configured to send signals to the blower 140 to adjust the speed of the blower 140, for example, to increase rate of airflow 118 if the airflow is determined to be low, based on information from one or more of sensors 128, 130, 132.

The HVAC system 100 includes one or more sensors 144*a-b* in signal communication with controller 152. Sensors 144*a-b* may include any suitable type of sensor for measuring air temperature, relative humidity, and/or any other properties of a conditioned space (e.g. a room or building). The sensors 144*a-b* may be positioned anywhere within the conditioned space, the HVAC system 100, and/or the surrounding environment. For example, as shown in the illustrative example of FIG. 1, the HVAC system 100 may include a sensor 144*a* positioned and configured to measure a return air temperature (e.g., of airflow 124) and/or a sensor 144*b* positioned and configured to measure a supply or treated air temperature (e.g., of airflow 120), a temperature of the conditioned space, and/or a relative humidity of the conditioned space. In other examples, the HVAC system 100 may include sensors positioned and configured to measure any other suitable type of air temperature (e.g., the temperature of air at one or more locations within the conditioned space and/or an outdoor air temperature) or other property (e.g., a relative humidity of air at one or more locations within the conditioned space).

The HVAC system 100 includes a thermostat 146, for example, located within the conditioned space (e.g. a room or building). The thermostat 146 is generally in signal communication with the controller 152 using any suitable type of wired or wireless connection. The thermostat 146 may be a single-stage thermostat, a multi-stage thermostat, or any suitable type of thermostat as would be appreciated by one of ordinary skill in the art. The thermostat 146 is configured to allow a user to input a desired temperature or temperature setpoint 148 for the conditioned space and/or for a designated space or zone such as a room in the conditioned space. The controller 152 may use information from the thermostat 146 such as the temperature setpoint 148 for controlling the compressor 106 and/or the blower 140 (e.g., to increase the rate of airflow 118 if it is determined to be low, based on information from one or more of sensors 128, 130, 132). In some embodiments, the thermostat 146 includes a user interface and display for displaying information related to the operation and/or status of the HVAC system 100. For example, the user interface may display operational, diagnostic, and/or status messages and provide a visual interface that allows at least one of an installer, a user, a support entity, and a service provider to perform actions with respect to the HVAC system 100. For example, the user interface may provide for display of alerts 150 (e.g., associated with a fault determined based on information from one or more of sensors 128, 130, 132) and/or messages related to the status and/or operation of the HVAC system 100.

As described in greater detail below, the controller 152 is configured to receive at least signals 134 and 136 from sensors 128 and 130, respectively. Generally, the controller 152 is configured to receive and interpret at least signals 134 and 136 (and optionally signal 138), to determine, based on the received signals, whether there is a loss of a charge or a low rate of airflow 118 across the evaporator coil 116, and take an appropriate action by modifying operation of the HVAC system 100 (e.g., by increasing the speed of blower 140, transmitting alert 150 to the thermostat 146, and/or shutting down the HVAC system 100). The controller 152 is described in greater detail below with respect to FIG. 4.

As described above, in certain embodiments, connections between various components of the HVAC system 100 are wired. For example, conventional cable and contacts may be used to couple the controller 152 to the various components of the HVAC system 100, including, the compressor 106, the expansion valve 114, the sensors 128, 130, 132, the blower 140, sensor(s) 144*a-b*, and thermostat 146. In some embodiments, a wireless connection is employed to provide at least some of the connections between components of the HVAC system 100. In some embodiments, a data bus couples various components of the HVAC system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 152 to other components of the HVAC system 100.

In an example operation of HVAC system 100, the HVAC system 100 starts up to provide cooling to a space based on temperature setpoint 148. For example, in response to the indoor temperature exceeding the temperature setpoint 148, the controller 152 may cause the compressor 106 and the blower 140 to turn on to startup the HVAC system 100. During operation of the HVAC system 100, the controller 152 receives signals 134 and 136 to monitor a first temperature 154, based on signal 134 from sensor 128, at or adjacent to the inlet of the evaporator coil 116 (e.g., or a circuit 202*a-d* of the evaporator coil 116—see FIG. 2) and a second temperature 156, based on signal 136 form sensor 130, at a position in or on the evaporator coil 116 that is downstream from the position of sensor 128 (see FIG. 2). A temperature difference 158 is determined based on the first and second temperatures 154, 156. In general, signals 134 and 136 may be received periodically or at intervals (e.g., each second, each 30 seconds, each minute, or the like), and a temperature difference 158 may be determined for each received pair of signals 134, 136 or for any appropriate subset of the received signals 134, 136.

The controller 152 determines whether the calculated temperature difference 158 exceeds a predefined threshold value. For example, the threshold value may be a maximum temperature difference below which the HVAC system 100 is considered to not be experiencing a loss of charge. If the temperature difference 158 exceeds the temperature-difference threshold, the controller 152 determines that there has been a loss of charge. In some embodiments, the temperature difference 158 may need to exceed the threshold value for at least a minimum interval of time (e.g., of 30 seconds, 5 minutes, 15 minutes). In response to determining the HVAC system 100 is experiencing/has experienced a loss of charge, an alert may be transmitted (e.g., for presentation as alert 150 on a display of the thermostat 146).

While the temperature difference 158 still exceeds the threshold value, the controller 152 may continue to monitor the first temperature measured by sensor 128 (i.e., at or adjacent to the inlet to the evaporator coil 116). If the first temperature 154 determined by sensor 128 is less than a threshold temperature (e.g., of 32° F.), the controller 152 may determine that the HVAC system 100 is experiencing/has experienced a critical loss of charge. In some embodiments, sensor 128 (or another sensor located at or near the same position as that of sensor 128) may provide a measurement of a pressure at or adjacent to the inlet to the evaporator coil 116 (e.g., or a circuit 202*a-d* of the coil 116—see FIG. 2). In such embodiments, the controller 152 may determine whether a critical loss of charge has occurred based on the pressure measurement (i.e., if the pressure falls below a threshold pressure value). If a critical loss of charge is detected, the controller 152 may cause the HVAC system 100 to cease operation, or shut down (e.g., by turning off the compressor 106 and the blower 140).

As another example, during operation of the HVAC system 100, the controller 152 may determine that the first temperature 154 (or a corresponding pressure) measured by sensor 128 falls below a threshold value when the temperature difference 158 is not greater than the temperature-difference threshold value. For example, if (i) the first temperature 154 measured via sensor 128 is less than a threshold temperate (e.g., of 32° F.) and (ii) the temperature difference 158 is less than the temperature-difference threshold, the controller 152 may determine that the rate of airflow 118 across the evaporator coil 116 is insufficient. In other words, in some embodiments, the controller 152 is able to discern between decreases in the first temperature 154 that are associated with an insufficient airflow 118 rather than with a loss of charge. Previous technologies lack the ability to distinguish between these faults. In response to determining that the rate of airflow 118 is insufficient, the controller 152 may cause the speed of the blower 140 to increase (e.g., by transmitting an appropriate control signal to the blower 140). If the speed of the blower 140 is at a maximum value, the HVAC system may be experiencing additional faults, and the controller 152 may cause the HVAC system to shut down (i.e., by turning off the compressor 106 and blower 140) to prevent damage to HVAC system 100. In response to determining the HVAC system 100 should be shut down, an alert may be transmitted (e.g., for presentation as alert 150 on a display of the thermostat 146).

Example Method of Operation

Figure 3:
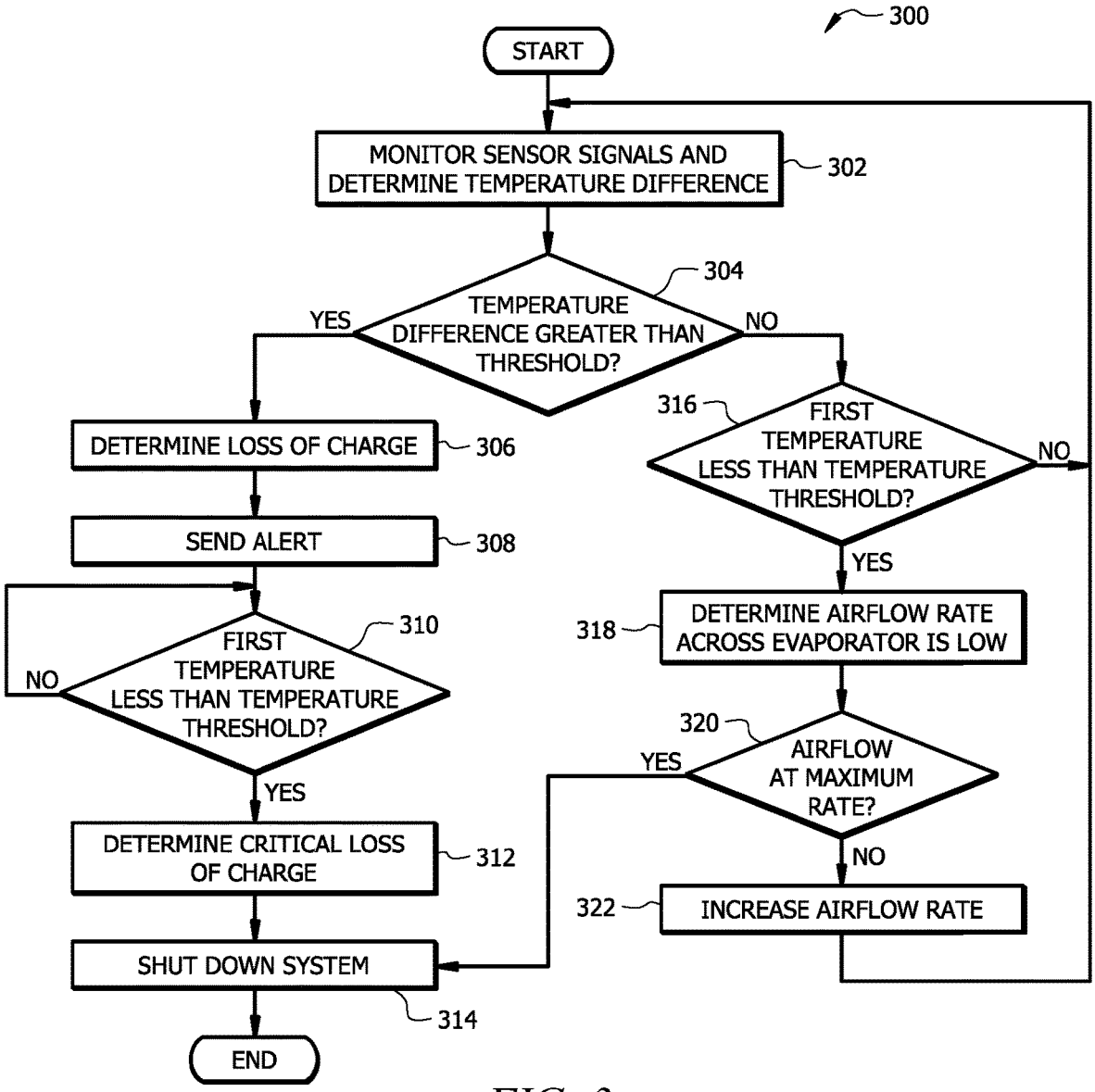
FIG. 3 is a flowchart illustrating an example method of detecting system faults in the example HVAC system illustrated in FIG. 1.

FIG. 3 is a flowchart illustrating an example method 300 of detecting faults during operation of the HVAC system 100 of FIG. 1. Method 300 generally facilitates the detection of system faults such as a loss of charge or an insufficient rate of airflow 118 across the evaporator coil 116. As described below, the method 300 may also facilitate the determination of an extent of the loss of charge (e.g., whether the loss of charge is critical and/or whether the HVAC system 100 should be shut down). Moreover, the method 300 may also be used to distinguish between when a fault is associated with a loss of charge versus when the fault is associated with an insufficient rate of airflow 118 across the evaporator coil 116. This distinction could not reliably be determined using previous technology.

The method 300 may begin at step 302 where the controller 152 monitors signals 128 and 130 and calculates the temperature difference 158 between the second temperature 156, based on signal 136, and the first temperature 154, based on signal 134. At step 304, the controller 152 determines whether the calculated temperature difference 158 is greater than a threshold temperature-difference value (e.g., threshold 408 illustrated in FIG. 4). For example, the difference threshold may be 7° F. In some embodiments, the temperature difference 158 may to exceed the threshold value for at least a minimum interval of time (e.g., of 30 seconds, 5 minutes, 15 minutes). If the calculated temperature difference 158 is greater than a threshold temperature-difference value, the controller 152 determines that the HVAC system 100 has experienced a loss of charge at step 306. At step 308, the controller 152 may transmit an alert signal (e.g., for presentation of alert 150 on a display of thermostat 146).

Figure 4:
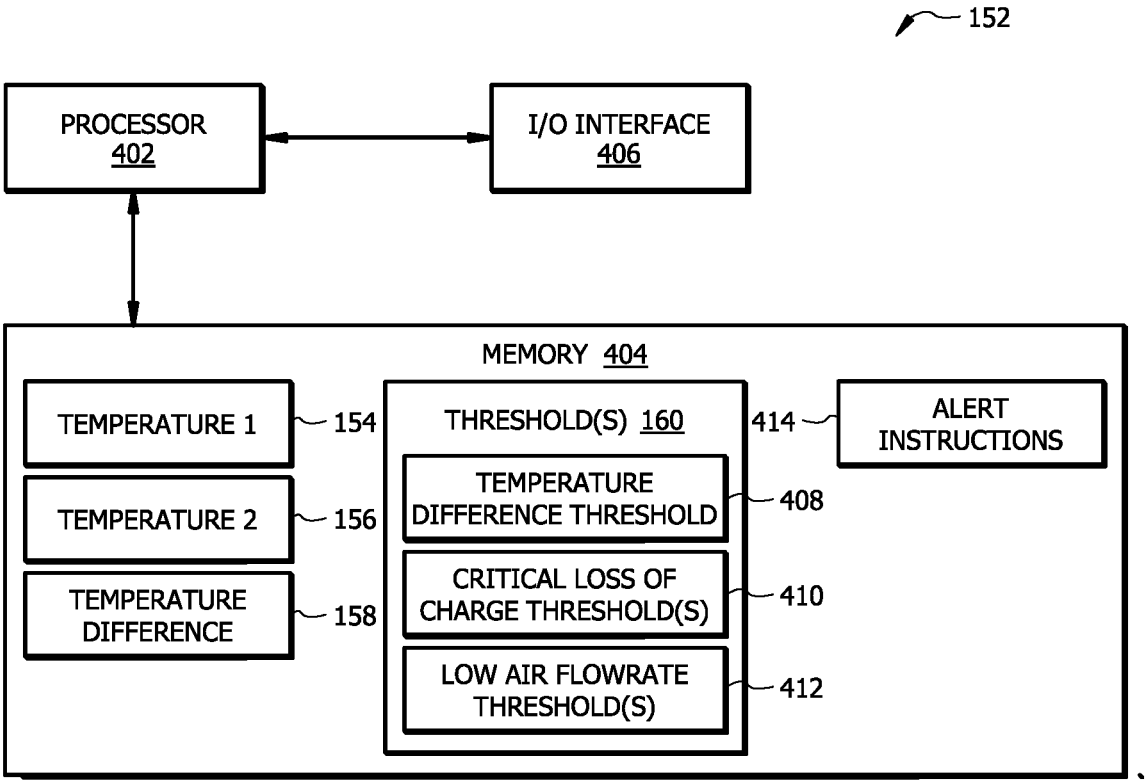
FIG. 4 is a diagram of the controller of the example HVAC system illustrated in FIG. 1.

At step 310, the controller 152 continues to determine whether the first temperature 154 measured via sensor 128 is less than a threshold temperature value (e.g., of 32° F., e.g., threshold 410 of FIG. 4). If the first temperature 154 is not less than the threshold temperature value, the controller 152 generally continues to monitor the first temperature 154 and repeat step 310 intermittently. In some embodiments, the controller 152 may further return to step 304 at certain intervals (e.g., every 30 seconds, 1 minute, 5 minutes, or longer) to determine whether the temperature difference 158 is still greater than the threshold temperature-difference value (e.g., to determine whether the loss of charge is still detected). In some cases, if a loss of charge is initially detected but is subsequently no longer detected (e.g., if the temperature difference 158 decreases during operation of the HVAC system 100) an alert signal may be transmitted to the thermostat 146 and/or another entity or device associated with maintenance of the HVAC system 100 indicating a need to test the system at some time in the future.

If at step 310 the first temperature 154 is less than the threshold temperature value, the controller 152 determines a critical loss of charge has occurred at step 312. In response to determining a critical loss of charge at step 312, the controller 152 may cause the HVAC system 100 to shut down (e.g., by turning off compressor 106 and blower 140). The controller 152 may further transmit an alert signal indicating the critical loss of charge (e.g., for presentation as alert 150 on a display of the thermostat 146).

Returning to step 304, if the temperature difference 158 is not greater than the temperature-difference threshold, the controller 152 still continues to monitor the first and second temperatures 154, 156. At step 316, the controller 152 determines whether the monitored first temperature 154, determined based on signal 134 from sensor 128, is less than a threshold value (e.g., of 32° F., e.g., threshold 412 of FIG. 4). If the first temperature 154 is less than the threshold value at step 316, the controller 152 may determine that the rate of airflow 118 across the evaporator coil 116 is low (or insufficient) at step 318. In response to determining that the rate of airflow 118 is low, the controller 152 may determine whether the speed of the blower 140 is at a maximum value (e.g., a maximum speed or flow rate indicated by the manufacturer) at step 320. If the blower 140 is not at its maximum speed, the controller 152 causes the speed of the blower 140 to increase at step 322. For example, the controller 152 may transmit a control signal to the blower 140 indicating an increased blower speed. If at step 320 the speed of the blower 140 is determined to be at its maximum value, the controller 152 may cause the HVAC system 100 to shut down (e.g., by turning off the compressor 106 and blower 140). An alert signal may also be transmitted (e.g., for presentation as alert 150 on a display of the thermostat 146).

Modifications, additions, or omissions may be made to method 300 depicted in FIG. 3. Method 300 may include more, fewer, or other steps. For example, steps may be performed in parallel or in any suitable order. For instance, in some embodiments, if the temperature difference 158 is found to be greater than the threshold value at step 304, the controller 152 may proceed to step 310 to determine whether there is a critical loss of charge. In such embodiments, an alert signal may only be transmitted (at step 308) if the critical loss of charge is detected. This example modification to the order of steps of method 300 may reduce or eliminate the presentation of false positive alerts in cases where an initially detected loss of charge (i.e., based on the determination at step 304) does not ultimately result in a critical loss of charge (i.e., based on the determination at step 310). While at times discussed as controller 152, HVAC system 100, or components thereof performing the steps, any suitable HVAC system or components of the HVAC system may perform one or more steps of the method.

Example Controller

FIG. 4 is a schematic diagram of an embodiment of the controller 152. The controller 152 includes a processor 402, a memory 404, and an input/output (I/O) interface 406.

The processor 402 includes one or more processors operably coupled to the memory 404. The processor 402 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 404 and controls the operation of HVAC system 100. The processor 402 may be a programmable logic device, a microcontroller, a microprocessor, or any suitable combination of the preceding. The processor 402 is communicatively coupled to and in signal communication with the memory 404. The one or more processors are configured to process data and may be implemented in hardware or software. For example, the processor 402 may be 8-bit, 16-bit, 32-bit, 64-bit or of any other suitable architecture. The processor 402 may include an arithmetic logic unit (ALU) for performing arithmetic and logic operations, processor registers that supply operands to the ALU and store the results of ALU operations, and a control unit that fetches instructions from memory 404 and executes them by directing the coordinated operations of the ALU, registers, and other components. The processor 402 may include other hardware and software that operates to process information, control the HVAC system 100, and perform any of the functions described herein (e.g., with respect to FIG. 3). The processor 402 is not limited to a single processing device and may encompass multiple processing devices. Similarly, the controller 152 is not limited to a single controller but may encompass multiple controllers.

The memory 404 includes one or more disks, tape drives, or solid-state drives, and may be used as an over-flow data storage device, to store programs when such programs are selected for execution, and to store instructions and data that are read during program execution. The memory 404 may be volatile or non-volatile and may include ROM, RAM, ternary content-addressable memory (TCAM), dynamic random-access memory (DRAM), and static random-access memory (SRAM). The memory 404 is operable to store values of the first temperature 154, values of the second temperature 156, values of the temperature difference 158, thresholds 160 (i.e., including a temperature-difference threshold 408, a critical loss of charge threshold 410, a low rate of airflow threshold 412), alert instructions 414, and/or any other logic and/or instructions for performing the function described in this disclosure.

Thresholds 160 generally include any thresholds used to implement the functions described herein including, for example, the temperature-difference threshold 408 (i.e., the maximum temperature difference before a loss of charge is detected), a threshold 410 for determining a critical loss of charge (i.e., a temperature or pressure below which a critical loss of charge is determined—see FIG. 3), and a threshold 412 for determining a low airflow rate (i.e., a temperature or pressure below which a critical loss of charge is determined—see FIG. 3). The alert instructions 414 generally include any instructions for how and where to transmit alert(s) 150.

The I/O interface 406 is configured to communicate data and signals with other devices. For example, the I/O interface 406 may be configured to communicate electrical signals with components of the HVAC system 100 including the compressor 106, expansion valve 114, sensors 128, 130, 132, blower 140, sensors 144*a-b*, and thermostat 146. The I/O interface may provide and/or receive, for example, compressor speed signals blower speed signals, temperature signals, relative humidity signals, thermostat calls, temperature setpoints, environmental conditions, and an operating mode status for the HVAC system 100 and send electrical signals to the components of the HVAC system 100. The I/O interface 406 may include ports or terminals for establishing signal communications between the controller 152 and other devices. The I/O interface 406 may be configured to enable wired and/or wireless communications.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation and air conditioning (HVAC) system, comprising:

an evaporator coil comprising an inlet for flow of refrigerant into the evaporator coil and an outlet for flow of the refrigerant out of the evaporator coil;

a first sensor operably coupled to the evaporator coil at a first position, the first sensor configured to monitor a first temperature of the refrigerant flowing in the evaporator coil at the first position;

a second sensor operably coupled to the evaporator coil at a second position, the second sensor configured to monitor a second temperature of the refrigerant flowing in the evaporator coil at the second position; and a controller communicatively coupled to the first sensor and the second sensor, the controller configured to:

receive, from the first sensor, a first signal corresponding to the first temperature;

receive, from the second sensor, a second signal corresponding to the second temperature;

determine, based on the received first and second signals, a temperature difference between the second temperature and the first temperature;

compare the determined temperature difference to a predefined threshold value; and determine whether the temperature difference is greater than the predefined threshold value;

if the temperature difference is greater than the predefined threshold value, determine that a loss of charge has occurred in the HVAC system;

if the temperature difference is not greater than the predefined threshold value:

determine whether the first temperature is less than a second threshold value; and if the first temperature is less than the second threshold value, determine that a rate of an airflow across the evaporator coil is low.

2. The system of claim 1, wherein the second position is located at between 10% and 50% of a length of a circuit of the evaporator coil.

3. The system of claim 1, wherein the controller is further configured to transmit an alert corresponding to the loss of charge to a user interface associated with the HVAC system.

4. The system of claim 1, wherein the controller is further configured to:

determine that the first temperature is less than a second threshold value;

in response to determining that the first temperature is less than the second threshold value, determine that the HVAC system has experienced a critical loss of charge; and transmit an alert corresponding to the critical loss of charge to a user interface associated with the HVAC system.

5. The system of claim 4, wherein the controller is further configured to, in response to determining that the HVAC system has experienced the critical loss of charge, cause the HVAC system to shut down.

6. The system of claim 1, the controller further configured to:

after determining that the rate of the airflow across the evaporator coil is low, transmit an alert indicating the low rate of the airflow across the evaporator coil.

7. The system of claim 6, further comprising a blower configured to provide the airflow across the evaporator coil;

wherein the controller is communicatively coupled to the blower, the controller is further configured to, in response to determining that the rate of airflow across the evaporator coil is low:

determine whether a maximum airflow rate has been reached for the blower;

in response to determining the maximum airflow rate has not been reached, cause a speed of the blower to increase; and in response to determining the maximum airflow rate has been reached, cause the HVAC system to shut down.

8. A method for detecting a loss of charge in a heating, ventilation, and air conditioning (HVAC) system, the method comprising:

receiving, from a first sensor, a first signal corresponding to a first temperature of refrigerant flowing in an evaporator coil of the HVAC system at a first position; and receiving, from a second sensor, a second signal corresponding to a second temperature of refrigerant flowing in the evaporator coil of an HVAC system at a second position;

determining, based on the received first and second signals, a temperature difference between the second temperature and the first temperature;

comparing the determined temperature difference to a predefined threshold value; and determining whether the temperature difference is greater than the predefined threshold value;

if the temperature difference is greater than the predefined threshold value, determining that a loss of charge has occurred in the HVAC system;

if the temperature difference is not greater than the predefined threshold value:

determining whether the first temperature is less than a second threshold value; and if the first temperature is less than the second threshold value, determining that a rate of an airflow across the evaporator coil is low.

9. The method of claim 8, wherein the second position is located at between 10% and 50% of a length of a circuit of the evaporator coil.

10. The method of claim 8, further comprising transmitting an alert corresponding to the loss of charge to a user interface associated with the HVAC system.

11. The method of claim 8, further comprising:

determining that the first temperature is less than a second threshold value;

in response to determining that the first temperature is less than the second threshold value, determining that the HVAC system has experienced a critical loss of charge; and transmitting an alert corresponding to the critical loss of charge to a user interface associated with the HVAC system.

12. The method of claim 11, further comprising, in response to determining that the HVAC system has experienced the critical loss of charge, causing the HVAC system to shut down.

13. The method of claim 8, further comprising:

after determining that the rate of the airflow across the evaporator coil is low, transmitting an alert corresponding to the low rate of the airflow.

14. The method of claim 13, in response to determining that the rate of the airflow across the evaporator coil is low:

determining whether a maximum airflow rate has been reached for a blower of the HVAC system;

in response to determining the maximum airflow rate has not been reached, causing a speed of the blower to increase; and in response to determining the maximum airflow rate has been reached, causing the HVAC system to shut down.

15. A controller for operating a heating, ventilation, and air conditioning (HVAC) system, the controller comprising:

an input/output interface configured to:

receive, from a first sensor, a first signal corresponding to a first temperature of refrigerant flowing in an evaporator coil of the HVAC system at a first position; and receive, from a second sensor, a second signal corresponding to a second temperature of refrigerant flowing in the evaporator coil of an HVAC system at a second position; and a processor configured to:

determine, based on the received first and second signals, a temperature difference between the second temperature and the first temperature;

compare the determined temperature difference to a predefined threshold value; and determine whether the temperature difference is greater than the predefined threshold value;

if the temperature difference is greater than the predefined threshold value, determine that a loss of charge has occurred in the HVAC system;

if the temperature difference is not greater than the predefined threshold value:

determine whether the first temperature is less than a second threshold value; and if the first temperature is less than the second threshold value, determine that a rate of an airflow across the evaporator coil is low.

16. The controller of claim 15, wherein the second position is located at between 10% and 50% of a length of a circuit of the evaporator coil.

17. The controller of claim 15, wherein the processor is further configured to transmit an alert corresponding to the loss of charge to a user interface associated with the HVAC system.

18. The controller of claim 15, wherein the processor is further configured to:

determine that the first temperature is less than a second threshold value;

in response to determining that the first temperature is less than the second threshold value, determine that the HVAC system has experienced a critical loss of charge; and transmit an alert corresponding to the critical loss of charge to a user interface associated with the HVAC system.

19. The controller of claim 18, wherein the processor is further configured to, in response to determining that the HVAC system has experienced a critical loss of charge, cause the HVAC system to shut down.

20. The controller of claim 15, wherein the processor is further configured to:

in response to determining the rate of the airflow across the evaporator coil is low, determine whether a maximum airflow rate has been reached for a blower of the HVAC system, the blower configured to provide the airflow across the evaporator coil;

in response to determining the maximum airflow rate has not been reached, cause a speed of the blower to increase; and in response to determining the maximum airflow rate has been reached, cause the HVAC system to shut down.

* * * * *